United States Patent [19]

Laird et al.

[11] 4,090,552

[45] May 23, 1978

[54] SHROUD LIFTING EQUIPMENT

[75] Inventors: Richard J. Laird, Trafford; Patrick V. Verrone, Pittsburgh, both of Pa.

[73] Assignee: Mesta Machine Co., Pittsburgh, Pa.

[21] Appl. No.: 759,043

[22] Filed: Jan. 13, 1977

[51] Int. Cl.[2] ..... B22D 11/10

[52] U.S. Cl. ..... 164/438; 164/259; 164/335

[58] Field of Search ..... 164/335, 259, 281

[56] References Cited

U.S. PATENT DOCUMENTS

| | | | |
|---|---|---|---|
| 3,460,725 | 8/1969 | Golde et al. | 164/335 X |
| 3,467,284 | 9/1969 | Koncsies et al. | 164/259 X |
| 3,616,843 | 11/1971 | Newhall | 164/281 |

*Primary Examiner*—Robert L. Spicer, Jr.
*Attorney, Agent, or Firm*—Carothers and Carothers

[57] ABSTRACT

In a continuous casting machine, the combination comprises a mould structure, a tundish car, a tundish, and a shroud for molten metal. An arrangement is provided for mounting the tundish shroud on the tundish car and for mounting the shroud adjacent the casting machine. The arrangement for mounting the shroud includes an elevating arrangement for raising the shroud into sealing engagement with a ladle when the latter is supported generally above the mould structure and for lowering the shroud to afford sufficient clearance for removal of the ladle.

12 Claims, 4 Drawing Figures

SHROUD LIFTING EQUIPMENT

The present invention relates to shroud lifting equipment and more particularly to equipment of the character described for use with continuous casting machines and the like. Continuous casting machines usually include a mould, a tundish having an outlet spout extending into the mould and an elevating mechanism for supporting a ladle having an outlet and shroud extending into the tundish during the casting operation. The refractory lining of the tundish is capable of withstanding the tapping of two or more ladles. The purpose of the shroud is to shield the molten metal stream issuing from the ladle from oxidizing effects of the ambient atmosphere and to permit use of a protective inert atmosphere such as argon.

In recently developed forms of continuous casting machines, the shroud is supported on the tundish and sealed against the bottom of the ladle. A problem arises whenever it is necessary to withdraw the tundish and its carriage for insertion of a new tundish usually on another carriage. At such times it is necessary to elevate the entire ladle, which may weigh well over three hundred tons, so that the shroud clears the ladle. As the ladle is usually held by extended arms of the ladle turret or other support, the leveraged forces are tremendous. Further, the ladle must be elevated high enough by the turret elevating mechanism to allow insertion of a lance into the ladle outlet to free up the ladle stopper rod or slide gate. These problems are rendered more complex by the necessity of elevating the tundish to remove its outlet spout from the mould.

The present invention overcomes these problems in a surprising manner with the provision of an arrangement for elevating a shroud independently of the ladle support and tundish. Accordingly, it is no longer necessary to elevate the extremely large mass of the ladle and its molten contents. The invention also incorporates means for pressing the detached shroud against the bottom of the ladle (adjacent its outlet) for a reliable seal, after the ladle has been placed in operation on the ladle turret and over the tundish. By the same token the shroud mechanism of the invention permits the shroud to be lowered relative to the ladle and the tundish to provide an unexpectedly more convenient access for lancing purposes. The invention permits lifting the tundish so that its spout clears the mould, while the shroud remains clear of the ladle to permit ready withdrawability of the tundish, shroud and carriage. Important and unexpected results of the invention are the elimination of the massive elevating mechanism in the ladle turret.

In another aspect of the invention means are unexpectedly provided for transferring the elevatable shroud and its supporting bracket from one tundish carriage to another. In most applications the provision of the detached and elevatable ladle shroud of the invention most importantly does not require additional clearance between the tundish and the ladle. Transfer of the shroud and its bracket is made, however, most appropriately after the tundish, shroud and bracket, and the carriage therefore are removed from between the mould and the ladle turret. In a preferred arrangement of the invention, the elevating mechanism for the shroud and its supporting bracket are readily but unexpectedly mounted on the tundish car, with the shroud and its bracket being readily disengaged therefrom. For other applications, the invention unexpectedly provides means for mounting the detached ladle shroud and its elevating mechanism on a stationary foundation or the like or elsewhere independently of the tundish carriage. However, when the ladle shroud and its elevating mechanism are mounted on the tundish car, the necessity in conventional practice for elevating the ladle to clear the shroud and tundish is unexpectedly obviated.

The invention accomplishes the aforedescribed results by providing in a continuous casting machine, the combination comprising a mould structure, a tundish car, a tundish, means for mounting the tundish on said tundish car, a shroud for molten metal means for mounting said shroud adjacent said casting tundish, said mounting means including an elevating arrangement for raising said shroud into sealing engagement with a ladle when supported generally above said mould structure and for lowering said shroud to afford sufficient clearance for removal of said ladle.

The invention also provides a similar continuous casting arrangement including said shroud being mounted on an elongated supporting bracket spanning said mould structure, said elevating arrangement including a pair of elevating meachanisms engaging the end portions respectively of said bracket.

The invention also provides a similar continuous casting arrangement wherein said mounting means and said elevating arrangement are mounted on said tundish car for insertion and withdrawal therewith and with the tundish.

The invention also provides a similar continuous casting arrangement wherein a pair of spaced guideways are mounted on said tundish car for receiving stabilizing plates respectively extending from said shroud bracket, said elevating mechanisms including respective housings therefor mounted on said tundish car respectively.

During the foregoing discussion, various objectives, features and advantages of the invention have been set forth. These and other objectives, features and advantages of the invention together with structural details thereof will be elaborated upon during the forthcoming description of certain presently preferred embodiments of the invention and presently preferred methods of practicing the same.

In the accompanying drawings there are illustrated certain presently preferred embodiments of the invention together with certain presently preferred methods of practicing the same wherein.

Figure 1:
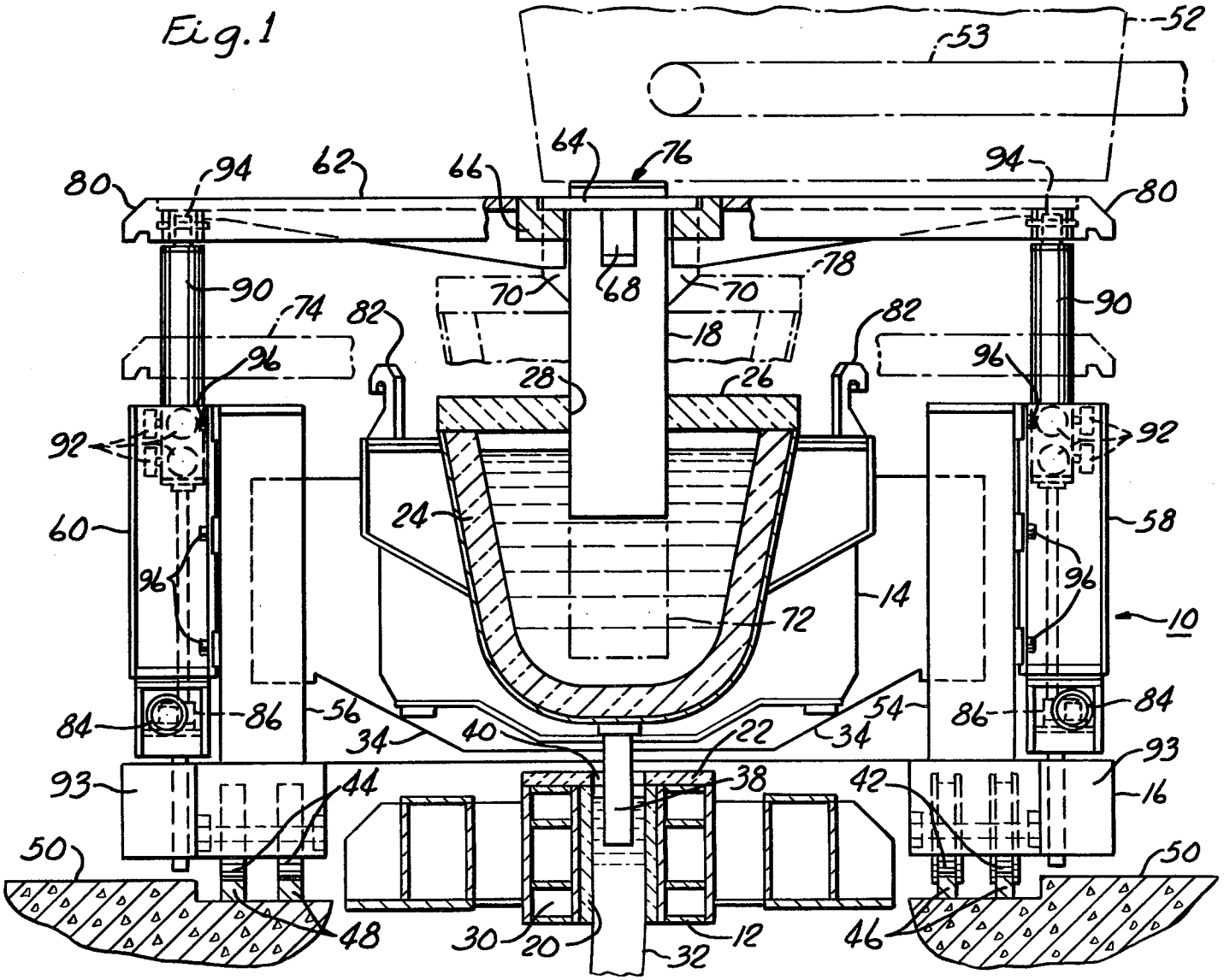
FIG. 1 is a front elevational view partially in section, of one arrangement of upper portions of a continuous casting machine in accordance with the invention.
Figure 3:
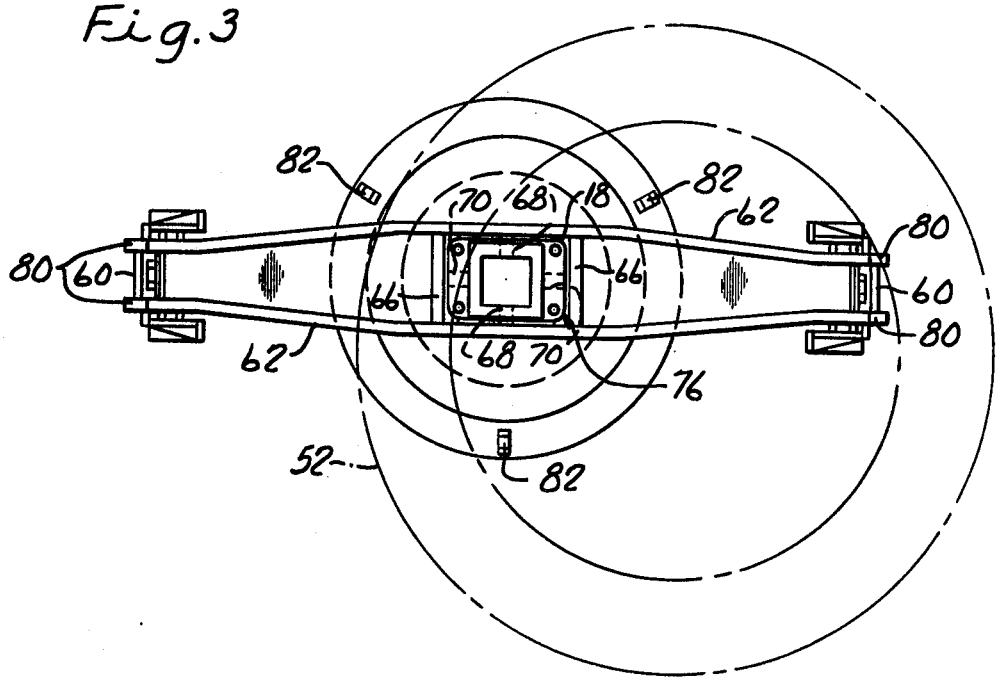
FIG. 3 is a top plan view of the casting machine portion depicted in FIGS. 1 and 2.
Figure 2:
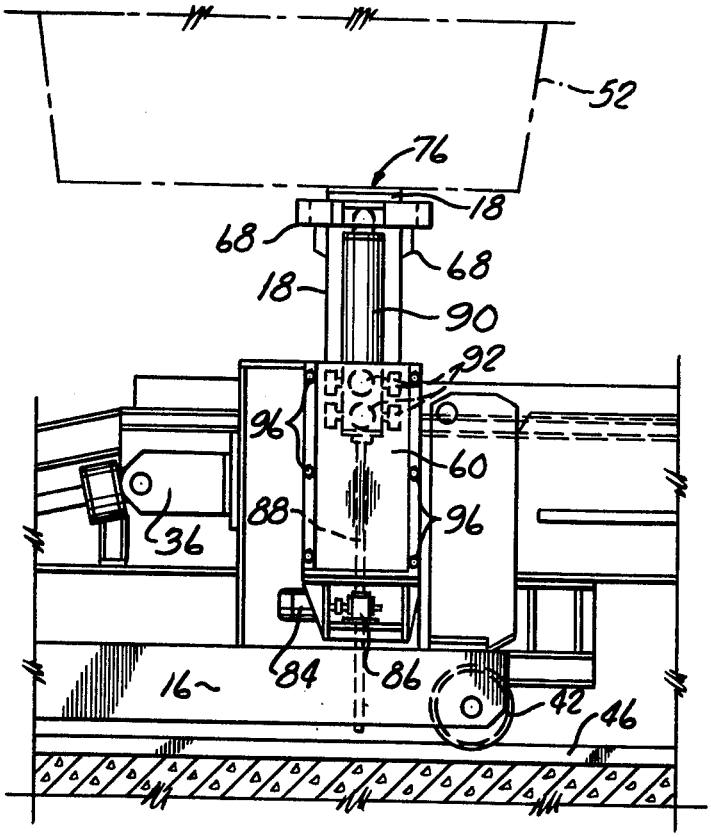
FIG. 2 is a partial, side elevational view of the casting machine as shown in FIG. 1.

With reference now more particularly to FIGS. 1–3 of the drawings, a continuous casting machine 10 includes a mould structure 12, tundish 14, tundish car 16 and an elevatable, detached ladle shroud 18. The mould 12 is provided with the usual refractory lining 20 of copper plates and cover 22. The tundish 14 is provided with a refractory lining 24 and refractory lid 26 which is apertured at 28 to receive closely the ladle shroud 18. Conventional means (not shown) can be provided for the injection of argon or other inert atmosphere into the shroud 18. The mould 12 is provided with a water jacket 30 or the like to promote congealing of the continuous cast slab or billet 32.

The tundish 14 is elevatable with respect to the tundish car 16 and is provided with side stabilizers 34 for guiding its vertical movement when lifted by a conventional tundish lift mechanism 36 (FIG. 2). Such elevation is required for the insertion and removal of tundish spout 38 with respect to the mould 12 through aperture 40 in the mould cover 22.

The tundish car 16 is provided with rail-engaging wheels 42 and 44 for running along pairs of steel rails 46, 48 mounted on a foundation 50 or other suitable support. Desirably, at least the wheels 42 are flanged for retaining the tundish car 16 upon its rails 46, 48. Upon elevating the tundish 14 and lowering the shroud 18 as described below the tundish 14 and shroud 18 can be inserted and withdrawn relative to their positions between the mould 12, and ladle 52 and its turret 53 or other support, by movements of the tundish car 16 along the rails 46, 48.

The tundish car 16 also guideways 54, 56 which are engaged by the tundish stabilizers 34 during elevating movements thereof. Adjacent the guides 54, 56 are mounted respectively housings 58, 60 containing elevating mechanisms for raising and lowering the ladle shroud 18 and its supporting bracket 62. The housing 58, 60 and the mechanisms contained therein constitute the elevating arrangement for the shroud 18 and juxtaposed to the mould 12.

The shroud bracket 62, as better shown in FIGS. 1 and 3 is an elongated beam construction adequate to support the weight of the shroud 18 which is inserted in this example through the bracket 62 adjacent the midpoint thereof. The shroud 18 in this example is heavily flanged at 64 adjacent its upper end, and the flange 64 rests upon and can be bolted to a central frame 66 of the shroud bracket 62. The frame 66 is shaped complementarily with the outer surfaces of the shroud 18 to receive closely the shroud 18 and to receive keyingly its flange stabilizing lugs 68, 70.

The aforementioned elevating mechanisms (described more fully below) are capable of elevating the shroud 18 and its supporting brackets 62 between the solid outline provisions thereof in FIG. 1 and their chain outline positions 72, 74 respectively. At the uppermost position of the shroud 18, as represented by its solid outlines in FIG. 1, the upper edges 76 thereof are pressed against the underside of the ladle 52 to form a reliable seal between the shroud 18 and the ladle 52 during pouring from the ladle. Before and during the pouring of molten metal into the tundish 14, a non-oxidizing atmosphere such as argon can be injected by conventional techniques into whose lower end is below the level of liquid metal in the tundish 14, the shroud 18, to avoid loss of the non oxidizing atmosphere.

At the lowermost positions 72, 74 of the shroud 18 and its bracket 62 adequate space is unexpectedly provided between the ladle 52 and the tundish 14 at the latter's lowermost position (denoted by the solid outlines of the tundish 14 in FIG. 1) for ready access to the bottom of the ladle 52 for lancing, maintenance, or other purposes. At the uppermost position of the tundish 14, denoted by its chain outline 78, the outlet spout 38 of the tundish readily clears the refractory cover 22 for installation and withdrawal of the tundish 14 and its car 16. At this time, the shroud 18 and its bracket 62 can be lowered a few inches or more to clear the bottom of the ladle 52 for removal of the tundish 14, tundish car 16, and the shroud 18 and its bracket 62 as the unit with respect to the ladle 52 and its turret 53 and the remaining components of the continuous casting machine 10. The shroud bracket 62 is provided with lifting hooks 80 and likewise the tundish 14 with lifting hooks 82 such that the shroud and bracket can be transferred between two or more tundish cars, and a given tundish 14 can be similarly transferred between cars or between a given tundish car 16 and a tundish stand (not shown).

With particular reference now to FIGS. 1 and 2 there is disclosed one arrangement of the aforementioned elevating mechanism for elevating the ends respectively of the shroud supporting bracket 62 with respect to the tundish car 16. In the lower end portion of each of the elevator housings 58, 60 are mounted conventional motive means such as reversible electric motor 84, a conventional gear box 86, and jack screw 88. The jack screws 88 are engaged in the conventional manner with the gear boxes 86 such that rotation of the electric motors 84 in one direction or another raises and lowers the associated jack screw 88.

A vertical support 90 for each end of the shroud bracket 62 is slidably mounted within the associated carriage housing 58 or 60. Each vertical support 90 is provided with a vertically disposed stud 94 which is keyingly and removably inserted into the shroud bracket 62 for ready removability of the bracket 62 and the shroud 18 from the tundish car 16. Each of the vertical supports 90 is slidably mounted in the associated housing 58 or 60 wherein it is supported on the top of the associated jack screw 88.

Desirably the drive motors 84 are synchronized electrically, for example by conventional pulse control or by a conventional master-slave arrangement so that each of the vertical supports 90 are raised and lowered by precisely equal amounts to prevent cocking or canting of the supports 90 within their respective housings 58, 60. However, against the possibility of such cocking or canting, the vertical posts 90 are provided with a number of guide rollers 92.

In the FIGS. 1–3 arrangement, the elevator housings 58, 60 desirably are permanently mounted on the tundish car 16, together with the vertical supports 90, jack screws 88 and the driving mechanism 84–86. In this connection the elevator housing 58, 60 can be bolted as denoted by reference numerals 96 or otherwise secured laterally to the tundish guideways 54, 56 respectively.

It will be appreciated that hydraulic or pneumatic cylinders can be substituted for the elevating mechanisms 84–90.

In the continuous casting machine 10, one will readily perceive that the shroud bracket conveniently spans the tundish 14 and the tundish guideways 54, 56 to facilitate mounting the shroud 18 and bracket 62 on the tundish car 16 and removal therefrom. In this connection the elevator housings 58, 60 are most appropriately mounted on the outward surfaces of the guideways 54, 56 respectively. It is contemplated of course, that the elevator housings 58, 60 can instead be mounted directly on base framework 93 of the tundish car 16. Save for the housings 58, 60, the tundish car can be constructed substantially in a conventional manner.

Figure 4:
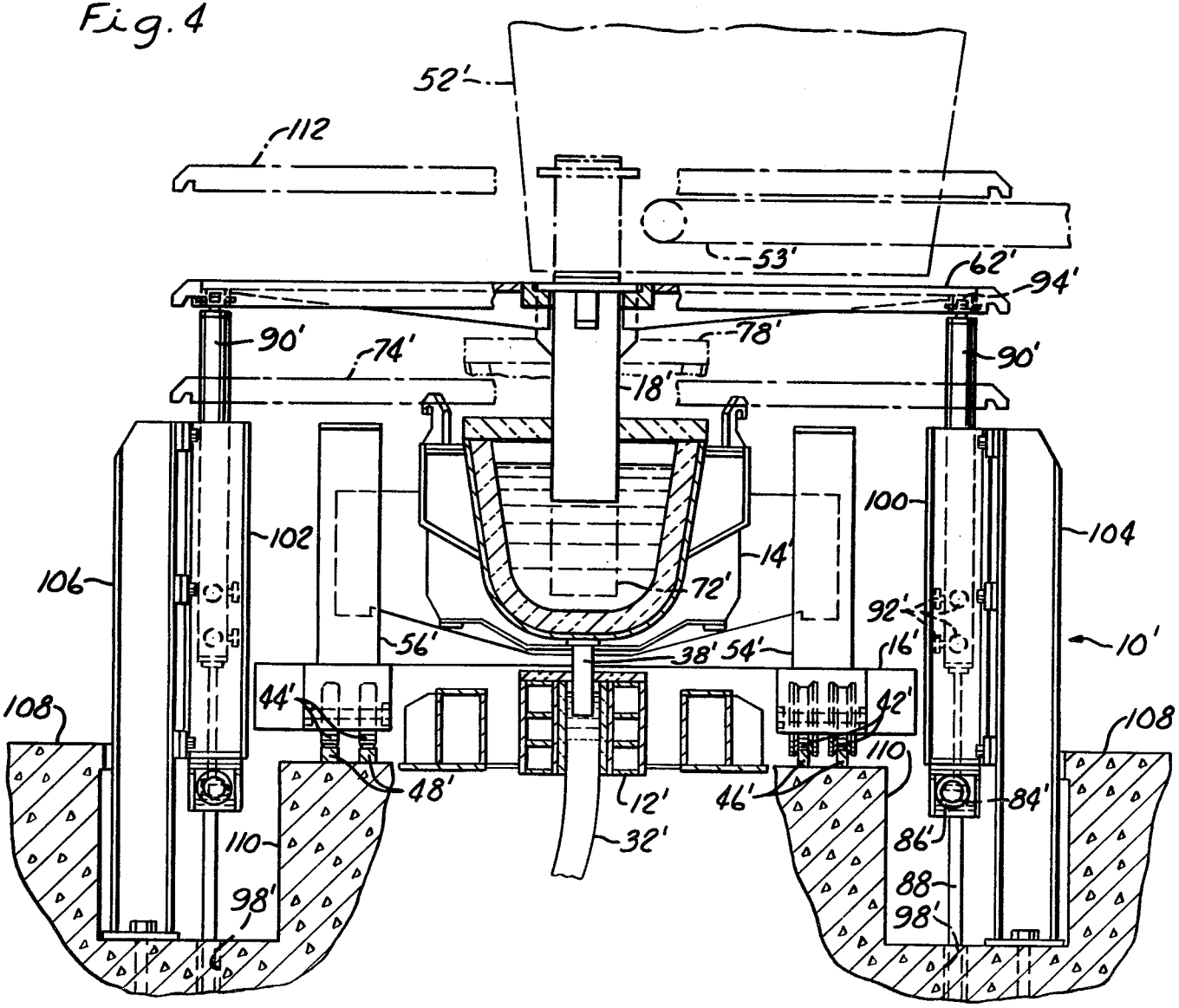
FIG. 4 is a front elevational view, partially in section, of another arrangement of the continuous casting machine of the invention.

Referring now to FIG. 4, where similar reference numerals with primed accents denote similar components of the preceding Figures, another arrangement 10' of the continuous casting machine of the invention is disclosed.

The continuous casting machine 10' includes a mould 12', tundish 14' and a conventional ladle support or turret (denoted partially at 53') for the ladle 52' all of which are supported substantially as described previously. However, the tundish car 16' does not include the aforedescribed housings for the shroud elevating mechanisms.

In the arrangement of FIG. 4 the elevating arrangement including the jack screws 88' and the drive arrangement 84'-86' and the vertical supports 90' are mounted in stationary housings 100, 102 which are bolted laterally and respectively to vertical and stationary posts 104, 106. The posts 104, 106 are mounted on a floor or foundation structure 108, for example in pits 110 shaped to receive the lower end portions of the posts 104, 106 and adjacent components of the elevating mechanisms. The pits 110 also afford personnel access to the elevating mechanisms for maintenance, repair and the like.

The elevating mechanisms and their housings 100, 102 are generally similar to the corresponding components of FIGS. 1-3, excepting that the housings 100, 102, the vertical supports 90' and the jack screws 88' are correspondingly longer (in the vertical direction) to accommodate the greater throw or range of movement of the shroud 18' and its supporting bracket 62'. This is occasioned by the necessity, in the FIG. 4 arrangement, of elevating the shroud 18' and its supporting brackets 62' to a higher position denoted by chain outline 112 thereof in order for the shroud 18' to clear the top of the tundish 14' as the latter is inserted or withdrawn relative to its operating position, as shown in FIG. 4. In the continuous casting machine 10 of the preceding Figures elevation above the solid outlines of the shroud 18' and supporting bracket 62' is unnecessary at the operating position of these components as the shroud 18 and bracket 62 are removed with the tundish 14 and its carriage 16. The greater throw of the elevating mechanisms provided by the elongated components 88', 90' and 100 allows the shroud 18' and its brackets 62' to be mounted at a stationary location with respect to the mould 12' and to the remaining components of the continuous casting machine.

When raising the shroud 18' and the bracket 62' to their uppermost position 112 the ladle 52' must be swung aside for necessary clearance. However, as in the preceding figures, it is not necessary to lift the extremely heavy mass of the ladle 52' in order to withdraw a conventional shroud and tundish.

For the ladle changing and lancing functions the shroud 18' and its bracket 62' are moved between their solid outline position in FIG. 4 and their chain outline lowermost position, as denoted generally at 74', by suitable and directional operation of the motors 86', as described previously in connection with FIGS. 1-3.

From the foregoing it will be seen that novel and efficient Shroud Lifting Equipment has been disclosed and described. The descriptive and illustrative materials employed herein are utilized for purposes of exemplifying the invention and not in limitation thereof. Accordingly, numerous modifications of the invention will occur to those skilled in the art without departing from the spirit and scope of the invention. It is to be understood that certain features of the invention can be used to advantage without a corresponding use of other features thereof.

We claim:

1. In a continuous casting machine, the combination comprising a mould structure, a tundish car, a tundish, means for mounting the tundish on said tundish car, a shroud for molten metal, means for mounting said shroud adjacent said casting machine portion, said mounting means including an elevating arrangement for raising said shroud into sealing engagement with a ladle when supported generally above said mould structure and for lowering said shroud to afford sufficient clearance for removal of said ladle, said shroud being mounted on an elongated supporting bracket spanning said mould structure, said elevating arrangement including a pair of elevating mechanisms engaging the end portions respectively of said bracket, a peripheral supporting flange mounted on said shroud adjacent an upper end thereof, a supporting framework mounted on said bracket adjacent a midpoint thereof and shaped complementarily with external surfaces of said shroud.

2. The combination according to claim 1 wherein said elevating arrangement is capable of lowering said shroud to a farther position to provide access for ladle lancing purposes.

3. The combination according to claim 1 including stud and complementary recess means mounted respectively on each of said elevating mechanisms and on the associated end portions of said supporting brackets for keying engagement of said bracket with said elevating mechanisms and for ready removal of said bracket and said shroud therefrom.

4. The combination according to claim 1 including flange supporting lugs mounted on said shroud and engaging said flange, said lugs fitting closely and respectively into openings therefor in said bracket frame.

5. The combination according to claim 1 wherein said elevating arrangement includes an elongated substantially vertically disposed housing, an elongated substantially vertical support slidably mounted in said housing, and motive means mounted in a bottom portion of said housing for raising and lowering said vertical support with respect to said housing.

6. In a continuous casting machine, the combination comprising a mould structure, a tundish car, a tundish, means for mounting the tundish on said tundish car, a shroud for molten metal, means for mounting said shroud adjacent said casting machine portion, said mounting means including an elevating arrangement for raising said shroud into sealing engagement with a ladle when supported generally above said mould structure and for lowering said shroud to afford sufficient clearance for removal of said ladle, wherein said mounting means and said elevating arrangement are mounted on said tundish car for insertion and withdrawal therewith and with the tundish.

7. The combination according to claim 6 wherein said mounting means and said elevating mechanisms are mounted on said tundish car, said shroud being mounted on an elongated supporting bracket spanning said mould structure, said elevating arrangement including a pair of elevating mechanisms engaging the end portions respectively of said bracket, and said shroud bracket likewise spans said tundish.

8. The combination according to claim 7 wherein a pair of spaced guideways mounted on said tundish car for receiving stabilizing plates respectively extending from said tundish, said elevating mechanisms including respective housings therefor mounted on said guideways respectively.

9. The combination according to claim 8 wherein said elevating mechanism housings are mounted on outward surfaces of said guideways respectively so that said shroud bracket likewise spans said guideways and said stabilizing plates.

10. In a continuous casting machine, the combination comprising a mould structure, a tundish car, a tundish, means for mounting the tundish on said tundish car, a shroud for molten metal, means for mounting said shroud adjacent said casting machine portion, said mounting means including an elevating arrangement for raising said shroud into sealing engagement with a ladle when supported generally above said mould structure and for lowering said shroud to afford sufficient clearance for removal of said ladle, said shroud being mounted on an elongated supporting bracket spanning said mould structure, said elevating arrangement including a pair of elevating mechanisms engaging the end portions respectively of said bracket, an elongated housing for each of said elevating mechanisms, said housings being juxtaposed to said mould structure but being sufficiently spaced therefrom and from one another for insertion of said tundish and said tundish car.

11. The combination according to claim 10 including means for stationarily mounting said housings on a foundation or other support structure for said continuous casting machine.

12. The combination according to claim 11 including components of said elevating mechanisms being sufficiently elongated to lower said shroud from said ladle to a first position to afford access for ladle lancing purposes and for raising said shroud to a second position to clear said tundish.

* * * * *